United States Patent [19]

Marsh et al.

[11] 4,246,817

[45] Jan. 27, 1981

[54] STAND FOR DISPENSING ROLLED SHEET STOCK

[75] Inventors: Walter G. Marsh, Detroit; James J. Rhoades, Garden City, both of Mich.; Frank Nolan, Cheshire, Conn.

[73] Assignee: Tapco Products Company, Inc., Detroit, Mich.

[21] Appl. No.: 24,505

[22] Filed: Mar. 28, 1979

[51] Int. Cl.[3] ..... B26D 7/02

[52] U.S. Cl. ..... 83/455; 83/649; 83/563; 242/57.1; 242/55.2

[58] Field of Search ..... 83/455, 649, 563; 242/57.1, 55.2, 55.3, 56 R, 56.6, 77, 78.1, 78.6, 129

[56] References Cited

U.S. PATENT DOCUMENTS

| | | | |
|---|---|---|---|
| 2,178,212 | 10/1939 | Schellenger | 242/55.2 |
| 3,222,972 | 12/1965 | Fulton | 83/649 X |
| 3,236,427 | 2/1966 | Martin | 83/649 X |
| 3,358,540 | 12/1967 | Hall | 83/455 |
| 3,370,497 | 2/1968 | Busse | 83/455 |
| 3,556,425 | 1/1971 | Keesling et al. | 242/57.1 |
| 3,641,854 | 2/1972 | Keesling | 83/455 X |

*Primary Examiner*—Donald R. Schran

*Attorney, Agent, or Firm*—Barnes, Kisselle, Raisch & Choate

[57] ABSTRACT

A coil stand for dispensing sheet aluminum trim or the like comprising a pair of supports carried by a base, one of which is adjustable longitudinally of the base to accommodate sheet rolls of differing widths. An arcuate array of rollers is carried by each support with the rollers of the supports being in opposed coaxial pairs. A pair of low friction spring biased keeper bars are carried by the respective supports to hold a roll of sheet stock against the rollers for free rotation. A cutting bar is cantilevered from the base for selectively clamping unrolled sheet stock against a support surface and provides a cutting edge for cooperation with a utility knife or the like for manually severing a desired amount of uncoiled sheet stock.

12 Claims, 5 Drawing Figures

72
86
82
90
76
72
86
10
54
82
132
138
134
124
152
154
108
78
26
106
110
60
64
104
110
100
50
21
21
102
62
35
38
17
37
46
31
19
22
22
12
20
16
23
23

146
148
122
130
114
142
156
152
153
150
112
108
104
110
154
134
54
60
58
56
40
37
42
44
50
52
30
21
38
-33-
31
17
46
14
23
19
136
120
128
126
106
34
36
66
68

STAND FOR DISPENSING ROLLED SHEET STOCK

The present invention is directed to dispensing apparatus, and more particularly to a stand for dispensing rolled sheet stock.

BACKGROUND AND SUMMARY OF THE INVENTION

A general object of the present invention is to provide an apparatus for dispensing rolled sheet stock, such as sheet aluminum or the like, coiled without a center core.

A more specific object of the invention is to provide a small and portable coil stand for dispensing and trimming at a job site rolled sheet aluminum for building trim, siding or the like.

Further objects of the invention are to provide a coil stand of the described type which is constructed of light weight materials and yet is rugged enough to withstand field use, which is adjustable for coils of varying dimension, which is easy to use, and which may be utilized selectively for storing or dispensing rolled sheet stock without damaging the finish of the stock material.

DESCRIPTION

Figure 2:
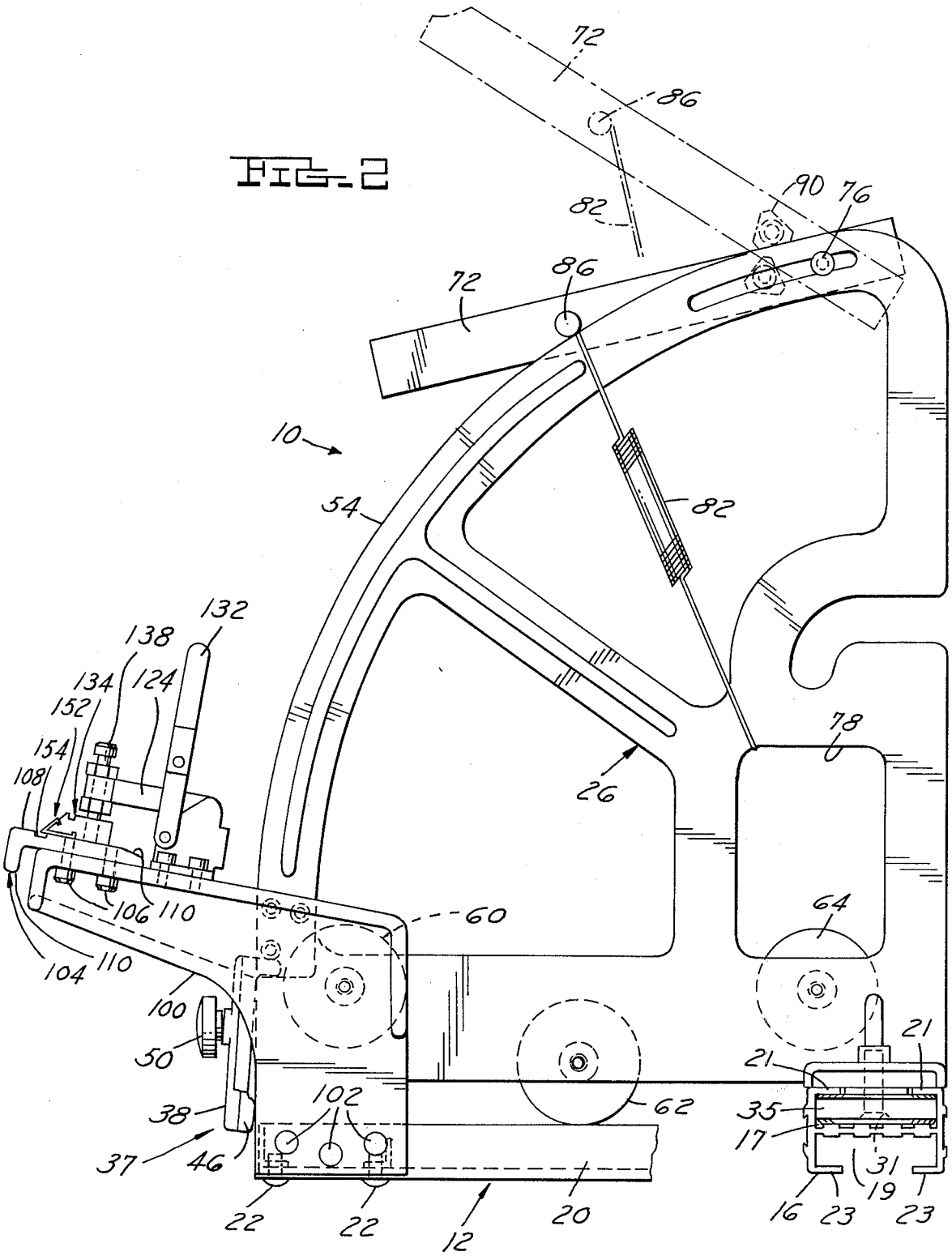
FIG. 2 is a side elevational view of the embodiment of the invention illustrated in FIG. 1.
Figure 3:
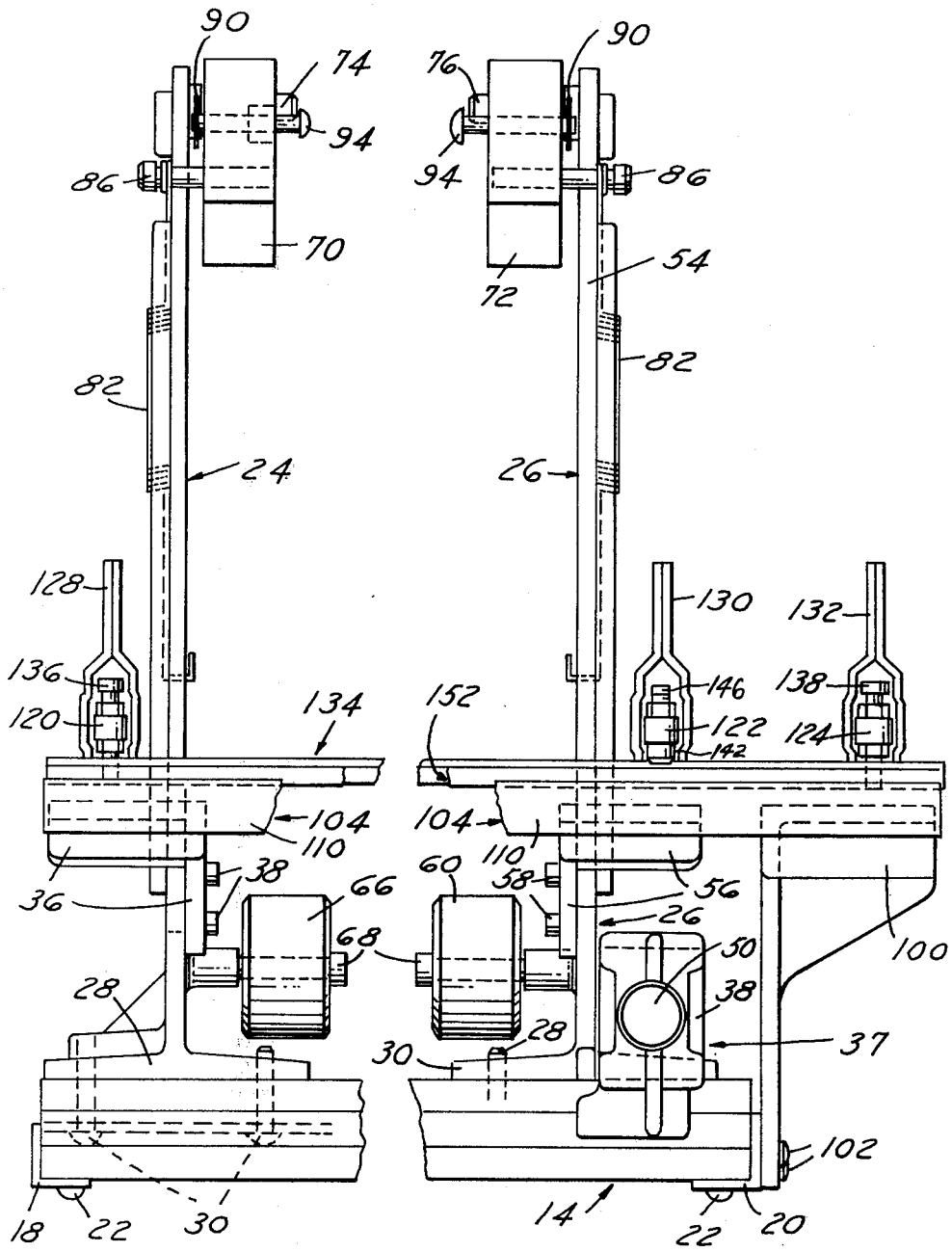
FIG. 3 is a fragmentary front elevational view of the embodiment illustrated in FIG. 1.

A coil stand 10 in accordance with the invention, which is shown to scale in FIGS. 2–5 of the drawings, comprises a pair of elongated parallel front and rear base tracks 14, 16 connected at their respected ends by the left and right base track tie bars 18, 20 (FIG. 2) to form a rigid planar rectangular base indicated generally at 12 having dimension parallel to the axes of the tracks. Tracks 14, 16 are identical and are preferably made of aluminum extruded in a generally H-shaped cross-sectional configuration defining separate upper and lower cavities 17, 19 each partially closed by the respective inwardly opposed flange pairs 21, 23. Tie bars 18, 20 extruded of aluminum are generally L-shaped in cross-sectional configuration, as best seen in FIG. 3, and are fastened to the ends of tracks 14, 16 by screws 22 threaded into the lower track flanges 23 such that an upwardly extending leg of the respective tie bars extends across the flanges 23 and closes the ends of lower track cavities 19.

Figures 4, 5:
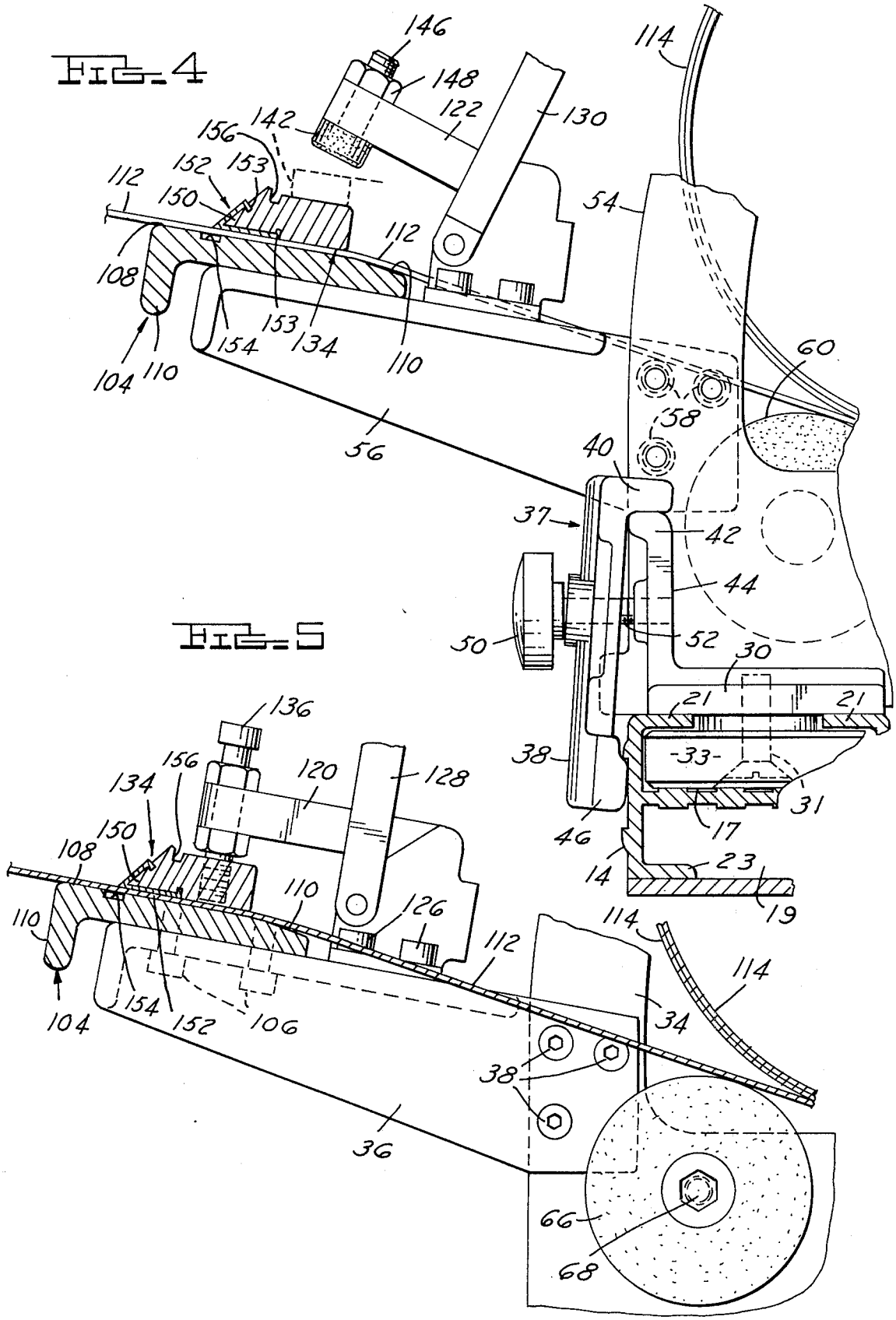
FIGS. 4 and 5 are sectional views taken along the respected lines 4—4 and 5—5 in FIG. 1.

A pair of upright coil supports 24, 26 of cast aluminum are carried by base 12. Referring to FIG. 3, left support 24 has a laterally flared integral base 28 at front and rear, and is fixedly mounted bridging the ends of tracks 14, 16 by the screws illustrated in phantom at 30. The upwardly projecting generally planar body of support 24 has an arcuate forward edge or rim 34 which extends for approximately ninety degrees. An upwardly angled support ledge 36 is cantilevered thereto by screws 38 (FIGS. 3 and 5). Similarly, right support 26 has a flared base 30 which is fastened (FIG. 2) by the screws 31 to front and rear blocks 33, 35 respectively slidable in the upper cavities 17 of front and rear tracks 14, 16. Right support 26 is thus slidable along opposing upper track flanges 21 and may be adjustably positioned with respect to fixed left support 24 longitudinally of the base. Support 26 has an arcuate front edge or rim 54 which extends for approximately ninety degrees and is coaxial when assembled with edge 34 of support 24. An upwardly angled support ledge 56 is cantilevered to edge 54 by screws 58 (FIGS. 3 and 4) and projects forwardly therefrom in parallel with the ledge 36 projecting from support casting 24.

A clamp 37 is carried by adjustable support 26 for clamping the support in a selected longitudinal position. Clamp 37 includes a generally C-shaped clamping member 38 as seen in FIG. 4 having an upper lip 40 received over the upper edge 42 of an upstanding ledge 44 on support base 30, and a lower lip 46 for clamping abutment with an opposing front surface of track 14. A threaded stud 52, having a knurled knob 50 fixedly attached thereto, is loosely received through an opening in a center boss 51 of clamp 38 and is threaded into an opposing threaded opening in ledge 44. Thus, rotation of knob 50 in one direction draws ledge 44 and clamp 38 toward each other, and thereby firmly clamps track 14 between support base 30 and lower clamp lip 46.

Arcuate arrays of three freely rotatable rollers are carried by the respective supports 24, 26 in opposed coaxial pairs, each roller being rotatable on a fixed axis on a shoulder bolt 68 threaded into a corresponding boss on the supports. The rollers 60, 62 and 64 carried by adjustable support 26 are illustrated in FIG. 2, in the preferred embodiment illustrated to scale in the drawings and are disposed in an upwardly concave arc of substantially thirty-five degrees centered on the vertical radius of substantially seven inches. The axes of outside rollers 60, 64 are disposed in a plane parallel to the plane of base 12. The array of rollers on fixed support 24 is a mirror image of the array on movable support 26 previously described. Only the front roller 66 which is coaxial with roller 60 is illustrated in FIGS. 3 and 5. Each of the rollers preferably comprises an annular cushion or tire of non-abrasive semi-resilient material such as polyethylene pressed or molded into a sleeve bearing (not shown).

A pair of generally rectangular tension bars 70, 72 are respectively pivotally cantilevered at one end inwardly of an upper edge of the corresponding supports 24, 26 by the coaxial shoulder bolts 74, 76 to pivot. A tension spring 82 extends between a side opening 78 in support 26 and a cap head screw 86 threaded into the outer side face of bar 72 forwardly of pivot bolt 74. Spring 82 normally biases bar 72 downwardly toward the support rollers 60–64 to the position illustrated in solid lines in FIG. 2 at which bolt 86 on the keeper bar acts as an abutment stop against the upper surface of support edge 54. A rivet 94 extends laterally outwardly through tension bar 72 and is captured therein for free sliding and rotational movement by a triangular retainer 90 of sheet metal. As best seen in FIG. 3, the spacing between ring 90 and the head of rivet 94 is greater than the width of bar 72, such that the rivet is free for axial movement between stop positions defined by the ring and rivet head. When bar 72 is pivoted to the position indicated in broken lines in FIG. 2, rivet 94 may be slid horizontally outwardly such a that ring 90 lies in the plane of support 26. A flat edge of ring 90 thereby will act as a stop to maintain the bar in an upper position. When the rivet is retracted, the tension bar is returned downwardly by spring 82.

Figure 1:
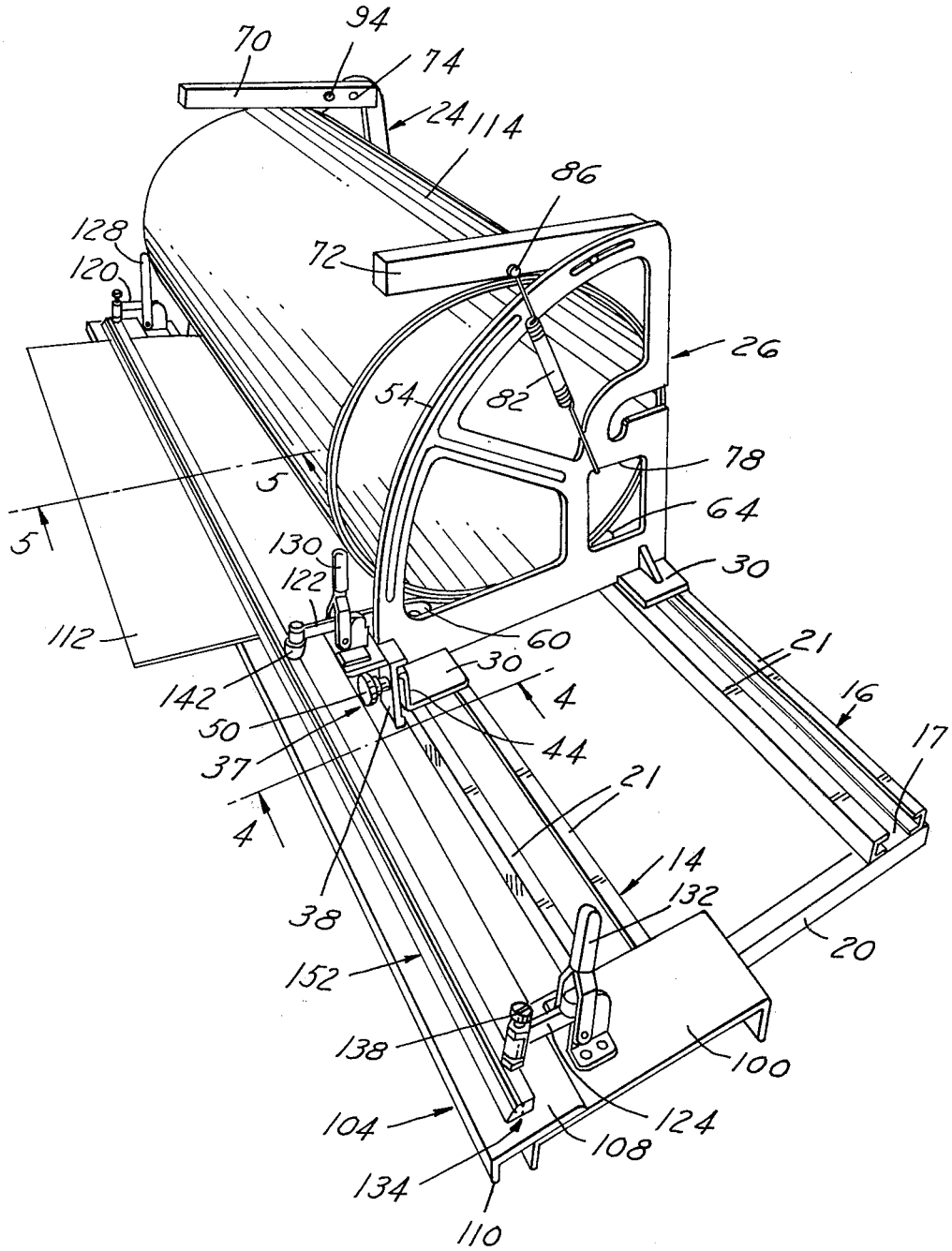
FIG. 1 is a perspective view of a presently preferred embodiment of the invention in use for dispensing rolled sheet aluminum.

A similar spring, rivet and retaining ring structure is fastened to left tension bar 70 and is indicated by identical reference numerals in FIGS. 3 and 4. Thus, tension bars 70, 72 may be lifted and retained in the upward orientation to permit loading of a stock roll (as at 114 in FIG. 1), and then released to hold stock roll firmly against the rollers. Preferably, the line of intact between the tension bars and the stock roll is above and slightly forward of the stock axis of rotation, so that the bars hold the stock against the rollers to counter the forward pulling force as stock is uncoiled. In this connection, it will be appreciated that the tension bars and support rollers eliminate any requirement for a center core in the stock roll. Bars 70, 72 are preferably constructed of or coated with low friction material such as polyethylene or the like to permit free sliding engagement between the tension bars and the rolled sheet stock as the latter is uncoiled, and thereby damage or abrasion to the stock surface finish.

A ledge 100 is fixedly fastened by the screws 102 to the front edge of tie bar 20 remotely of fixed support 24, and projects forwardly therefrom in parallel with ledges 36 and 56. The upper surfaces of ledges 36, 56 and 100 lie in a common plane which contains approximately the axes of the rear support rollers (64 in FIG. 2). A support bar 104 of extruded aluminum is cantilevered from base 12 by mounting the same to the upper coplanar surfaces of ledged 36, 56 and 100 as by screws 36, 100. The upper surface of movable ledge 56 is in sliding supportive contact with bar 104. Support bar 104 has a flat upper surface 108 at a preferred angle of approximately ten degrees with respect to the plane of base 12, and a downwardly turned front lip 110. The plane of surface 108 is thus carried above the axis of the nearest or front pair of support rollers 60, 66 and at a preferred angle of about eight degrees with respect to the tangent at the line of contact between coil 114 and the front rollers. The rearward portion 116 of surface 108 is tapered downwardly fifteen degrees toward the periphery of rollers 60, 66.

Three clamps 120, 122 and 124 are mounted by screws 126 on respective support ledges 36,56 and 100 rearwardly adjacent support bar 104 to pivot on a common axis parallel to the longitudinal dimension of base 12 under control of corresponding clamp handles 128, 130 and 132. A cutting bar 134 of extruded aluminum is suspended by adjustable screws 136,138 between the outer fixed clamps 120,124 to pivot conjointly therewith between an upper or retracted position (not shown) and a lowered position illustrated in FIGS. 2, 4 and 5 for firmly clamping sheet stock 112 unrolled from beneath coil 114 against surface 108. Center clamp 122, which is movable with respect to cutting bar 134, has a compressible resilient snubber 142 adjustably mounted thereto for pressing against the cutting bar to assist the sheet-clamping function of the latter. Thus, clamp 132 is movably carried by adjustable support 26 between fixed clamps 120,124 and is adapted selectively to engage the cutting bar at the adjusted position of support 26 intermediate fixed clamps 120,124. As will best be appreciated with reference to FIGS. 4 and 5, uncoiled sheet stock 112 clamped against surface 108 by cutting bar 134 is bent in a direction reverse to the coiling direction on the stock roll, sloped surface 110 functioning to prevent abrasion and kinking. This particular configuration has been found to be advantageous. Cutting bar 134 includes a sharp forwardly projecting front edge 150 at preferred acute angle of fifty-two and one-half degrees to surface 108.

A wear and corrosion resistant edge strip 152 of stainless steel or the like is received over bar edge 150 by having tongues 153 along side edges of the strip received by resilient snap-fit into corresponding grooves in the cutting bar. A longitudinal channel 154 is formed in surface 108 beneath the forward pointed edge in the clamping position of cutting bar 134 for receiving the blade of a utility knife or the like (not shown) as the latter is drawn by the workman along the cutting edge 152 for severing the uncoiled position of the sheet stock. A longitudinal groove 156 is formed in the upper portion of cutting bar 134 for receiving the lip of a tape measure or the like conveniently to provide a measurement reference for sheet stock withdrawn from the roll.

From the foregoing description, it will be appreciated that the preferred embodiment of the invention hereinabove described fully satisfies all of the objects and aims previously set forth. For example, in one embodiment of the invention the coil stand is adjustable for coil possessing an axial dimension between eight and thirty inches and is adapted to support coils weighing up to two hundred fifty pounds, while itself weighing only nineteen pounds. The stand is less than three feet in length and preferably is constructed almost entirely of light weight extruded or cast aluminum as previously described. The stand may be readily supported on the back of a pick-up truck, on the ground or on optional legs.

The invention claimed is:

1. A coiled stand for dispensing rolled sheet stock comprising a base having, a pair of upright support means carried by said base with at least one of said support means being adjustably positionable longitudinally of said base, said adjustable support means including means for locking said support means in a selected longitudinal position, each of said support means including a plurality of rollers on an arc for supporting a roll of sheet stock, first by means carried longitudinally of said base laterally of said support means for defining a flat clamping surfaces, and second means including a cutting edge for clamping uncoiled sheet stock against said flat surface to facilitate severing a portion of the uncoiled stock extending beyond said surface.

2. The coil stand set forth in claim 1 wherein said rollers are disposed in opposed pairs on said support means with each said pair being aligned on a fixed axis.

3. The coil stand set forth in claim 2 wherein said flat surface is disposed in a plane above the nearest of said roller pairs and at an angle with respect to said base such that sheet stock is bent in a direction opposite to the direction of coiling in a stock roll as the stock is uncoiled and clamped against said clamping surface.

4. The coil stand set forth in claim 3 wherein said first means extends for the longitudinal length of said base and includes means for suspending the same in a fixed position at the opposite longitudinal ends of said base.

5. The coil stand set forth in claim 3 wherein said second means comprises a pair of first clamps fixedly positioned at opposite longitudinal ends of said base, a cutting bar suspended between said first clamps for conjoint movement with said first clamps against said surface, and a second clamp movably carried with respect to said cutting bar by said at least one support means between said first clamps and adapted selectively to engage said cutting bar to clamp said cutting bar against said surface at the adjusted position of said at least one support means intermediate said pair of first clamps.

6. The coil stand set forth in claim 5 wherein said cutting edge is disposed at an edge of said cutting bar remote from said support means, and wherein said flat surface includes a longitudinal channel extending beneath said cutting edge in the clamped position of said cutting bar against said surface for receiving the blade of a utility knife or the like.

7. The coil stand set forth in claim 2 wherein each of said pluralities of rollers comprises three rollers disposed in an upwardly concave array on a radius substantially seven inches over an arc of substantially thirty-five degrees.

8. The coil stand set forth in claim 2 further comprising means carried by said support means for holding a said roll of sheet stock firmly against said roller pairs against pulling forces on said roll as stock is uncoiled therefrom.

9. The coil stand set forth in claim 8 wherein said holding means comprises a pair of tension bars pivotally carried at an upper portion of respective ones of said support means and means biasing said tension bars downwardly toward said rollers.

10. The coil stand set forth in claim 9 wherein said bars have a low friction surface for free sliding contact with roll stock as sheet material is uncoiled.

11. The coil stand set forth in claim 10 further comprising means for selectively locking each of said bars in an upwardly pivoted position to facilitate insertion and removal of a stock roll.

12. The coil stand set forth in claim 1 wherein said base comprises a pair of parallel tracks, and wherein said support means comprises a first support fixedly carried at one end of said tracks and a second support slidably carried between said tracks.

* * * * *